US006443791B1

(12) United States Patent
Portwine

(10) Patent No.: US 6,443,791 B1
(45) Date of Patent: Sep. 3, 2002

(54) VERTICALLY DISPOSED BUBBLE MAKER

(76) Inventor: Wayne K. Portwine, 12368 W. View Ridge Dr., Boise, ID (US) 32709

( * ) Notice: Subject to any disclaimer, the term of this patent is extended or adjusted under 35 U.S.C. 154(b) by 0 days.

(21) Appl. No.: 09/835,773

(22) Filed: Apr. 16, 2001

(51) Int. Cl.[7] ..... A63H 33/28; A63H 23/08
(52) U.S. Cl. ..... 446/15; 446/16; 446/267
(58) Field of Search ..... 446/15, 16, 17, 446/18, 19, 20, 21, 267

(56) References Cited

U.S. PATENT DOCUMENTS

| | | | | | |
|---|---|---|---|---|---|
| 3,818,627 | A | * | 6/1974 | Lebensfeld | 215/365 |
| 4,867,724 | A | * | 9/1989 | Sheng | 446/15 |
| 5,839,936 | A | * | 11/1998 | Lin | 446/16 |
| RE36,131 | E | * | 3/1999 | Schramm | 446/20 |
| 2001/0035413 | A1 | * | 11/2001 | Thai | 446/15 |

* cited by examiner

*Primary Examiner*—Jacob K. Ackun
*Assistant Examiner*—Faye Francis

(57) ABSTRACT

A vertically disposed bubble maker comprising a specially designed container for reducing the amount of a bubble solution required for dipping a large, vertically oriented, bubble forming loop in bubble solution for blowing bubbles. A wand comprises a handle attached to the loop, and there is a loop opening inside the loop. The container retains a liquid bubble solution, is open at the top, and is large enough so that the loop opening can be fully submerged in bubble solution when the loop is vertically oriented and when the container is full. The container has a shape that is substantially conformal to the shape of the vertically oriented loop when both the loop and the container are viewed from above. In the preferred embodiment, the container comprises a lower and an upper section, the lower section is the holster, the upper section is the reservoir. In this embodiment, the width of the reservoir is greater than the width of the holster, and the vertical cross-sectional area of the reservoir is greater than the vertical cross-sectional area of the holster. The bubble maker may also include a lid for covering the container, which would better allow the container to be stored with the bubble solution still inside. The lid would serve to prevent dirt and debris from entering the bubble solution during storage. The lid may also seal the container to prevent the bubble solution from leaking or spilling when the container is moved or tipped.

8 Claims, 6 Drawing Sheets

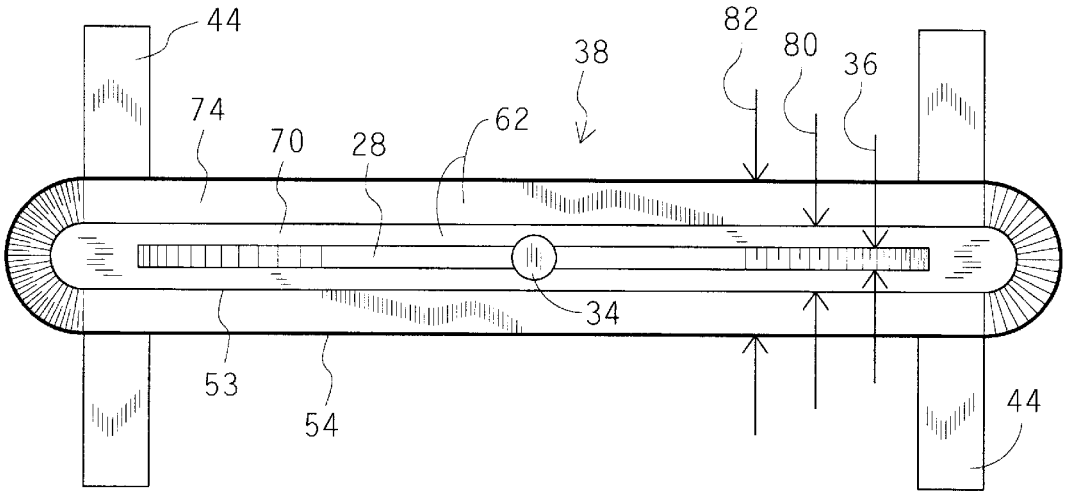
FIG. 4
FIG. 5
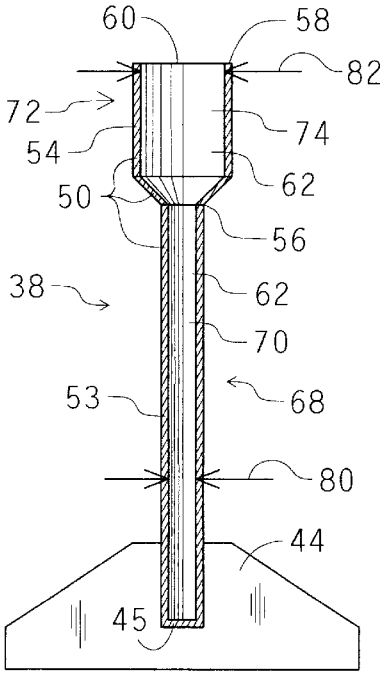
FIG. 6
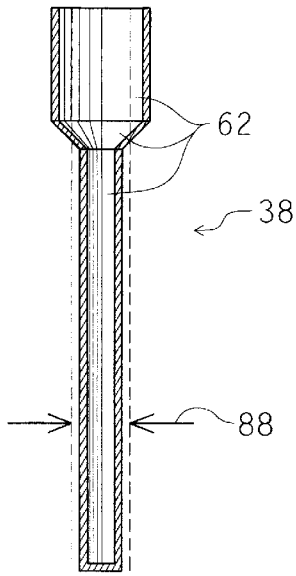

VERTICALLY DISPOSED BUBBLE MAKER

BACKGROUND OF THE INVENTION

1. Field of the Invention

This invention relates to toys used for inflating bubbles for entertainment purposes, in particular, a vertically disposed bubble maker with reduced container volume.

2. Background of the Invention

Everyone enjoys blowing bubbles, and the bigger the bubbles the better. Even small children can form large bubbles by simply waving large diameter bubble forming loops through the air. Since small children do not have the coordination to operate the complicated fabric type and lever-activated, folding type loops, they must stick with simple, rigid, single piece loops. Two basic categories of containers can be used for dipping these large diameter loops in bubble solution. The first category includes containers that accommodate vertically oriented loops while the second category includes containers that accommodate horizontally oriented loops. Dipping a loop that is vertically oriented will be referred to as vertical dipping, while dipping a loop that is horizontally oriented will be referred to as horizontal dipping.

The first category of dipping containers includes bucket-like containers that are adequately sized for vertically dipping a loop. There are several advantages of having the loop vertically oriented during dipping. One advantage is that most of the excess solution runs off the loop as it is being removed from the container, so less bubble solution runs off onto the ground during the inflation of bubbles. This results in less bubble solution being wasted.

Another advantage of vertically dipping loops is that there is no apparent limit on the maximum size loop that can be successfully dipped, provided a large enough container can be found to accommodate the loop. A loop cannot be much over twenty-five to thirty centimeters in diameter when horizontal dipping a loop because the thin film pops when the loop is raised up from the bubble solution. However, testing has demonstrated that it is easy to form a thin film of bubble solution across a loop that is one hundred centimeters in diameter when it is dipped with the plane of the loop in a vertical orientation.

Unfortunately, a very large volume of bubble solution is required for dipping a very large, vertically oriented loop. This is the primary disadvantage of using bucket-like containers. For example, if a large circular bucket is used for dipping a vertically oriented, forty-five centimeter diameter loop, then the bucket would have to have both a diameter and a height of at least forty-five centimeters. A bucket this size would require about seventy-five liters of bubble solution, a quantity that is far beyond what is practical for most families.

As a result, larger sized loops are almost always horizontally dipped in bubble solution held in shallow, flat trays. FIGS. 1 and 2 are perspective views of shallow, flat tray 8 in use. A loop typically has a loop handle attached to it for easier handling, and the loop with the loop handle together form a wand. FIGS. 1 and 2 show offset-handle wand 2, which consists of round loop 4 and offset-handle 6. See FIG. 1. To form a thin film of bubble solution across the opening of this large round loop 4, round loop 4 is dipped in shallow, flat tray 8 containing bubble solution 16. Shallow, flat tray 8 is designed so that tray sidewall 10 has a shape that is larger than the outline of horizontally oriented round loop 4 when viewed from above. This allows round loop 4 to fit into shallow, flat tray 8. However, there are serious disadvantages to horizontally dipping loops in shallow, flat trays 8.

Refer to FIG. 1. When using shallow, flat tray 8 for dipping round loop 4, handle 6 must be offset from the plane of round loop 4. Offsetting handle 6 from the plane of round loop 4 makes it possible for round loop 4 to sit flat against tray bottom 12 without handle 6 hitting tray sidewall 10. However, FIG. 2 shows that if offset-handle wand 2 is held upside down, then it is no longer possible to submerge round loop 4 in bubble solution 16. As a result, it is difficult for small children to use offset-handle wands 2 because children do not understand the concept of keeping offset-handle wand 2 rightside-up. This means that an adult must be dedicated to assisting smaller children almost full time. Another disadvantage of horizontally dipping loops can be seen in FIG. 1. Offset-handle 6 must be lowered almost to ground level 14 in order to get loop 4 submerged in bubble solution 16. This requires that the operator stoop way down each time loop 4 is dipped. This constant stooping quickly becomes unpleasant, especially for the adults that are blowing bubbles with their children.

Another disadvantage of dipping horizontally oriented loops is that both the loop and the thin film itself retain a large amount of excess bubble solution as the loop is being raised up from the solution. This excess solution runs off only after the user rotates the loop to a vertical plane in order to wave the loop through the air. If the user rotates the loop to a vertical plane while the loop is still over the dipping container, then the excess solution will run off into the solution in the container. Typically, however, the user isn't thinking about this and the excess solution runs off onto the ground, so large amounts of bubble solution are wasted.

Another disadvantage is discovered when it is time to clean up. It is difficult to pour the bubble solution from a shallow, flat tray back into a storage bottle without pouring most of the solution down the outside of the bottle. Even if you could get the solution back into the container, you probably would not want to save the solution from a shallow, flat tray anyway. The top of a shallow, flat tray is only a few centimeters or so above the ground, and rests only centimeters away from the operator's feet. This means that invariably, dirt and debris will be kicked into the solution during use. However, even if the solution is kept clean enough for future use, rather than having to bother with pouring the solution back into a storage container, perhaps it would be possible to use a lid with a shallow, flat tray so that the bubble solution could be stored in the shallow, flat tray itself. However, even this is not practical. It is difficult to remove a lid from a shallow, flat tray without causing the solution to slosh all over, making a mess in the process. As a result, the remaining solution is typically just tossed over the grass to avoid the hassle.

Finally, there is a limit on the maximum size loop that can be used with a shallow, flat tray for blowing bubbles. When the diameter of a circular, bubble forming loop reaches about twenty-five to thirty centimeters, it becomes difficult to form a thin film of bubble solution across the opening of the loop without popping the thin film in the process. This is because it is difficult for the thin film to free itself from the solution in the tray without popping when the plane of the loop is horizontally oriented during dipping. As pointed out above, there is apparently no limitation on loop size if the plane of the loop is vertically oriented when it is dipped.

SUMMARY OF THE INVENTION

Accordingly, it is an object of this invention to provide a bubble solution container which can be used for vertically dipping loops while also minimizing the amount of bubble solution needed to fill the container. Design features allowing this object to be accomplished include a vertically disposed container that has a top view shape that is substantially conformal to the top view shape of a vertically oriented loop. An example of this can be seen in FIG. 8 where the top view shape of first alternate container sidewall 51 is substantially conformal to the top view shape of loop 28. There are at least six advantages associated with the accomplishment of this object.

First, users can now dip their loops in bubble solution while they remain standing in an upright position. Eliminating the need for users, especially adults, to stoop way down to dip their loops in bubble solution makes producing bubbles much more fun and easier on the back.

The second advantage gained by achieving this object is that there is apparently no limit on the maximum size of the loop that can be used if the loop is in a vertical orientation when it is dipped. The third advantage of accomplishing this objective is that most of the excess bubble solution runs off a vertically oriented loop as it is being raised up from the solution. This means that for vertically oriented loops, the excess solution runs back into the container rather than onto the ground, so much less solution is wasted.

The fourth advantage of realizing this objective results from the container having the same top view shape as the vertically oriented loop when viewed from above. The advantage here is that the quantity of bubble solution needed to fill the container is greatly reduced, and is in fact comparable to the amount of solution used in the shallow, flat trays described in the prior arts section. An example in the previous section pointed out that a bucket would require over seventy-five liters of bubble solution for dipping a vertically oriented, forty-five centimeter loop. A container of this invention would require less than three liters for dipping the same loop.

The fifth benefit realized by attaining this objective is that there is no longer any need for offsetting the handle from the plane of the loop. This benefit eliminates the possibility of having the loop reversed when dipping, which eliminates the frustration children experienced when using shallow, flat trays. It also results in freedom for the parents that no longer have to assist these small children.

The six benefit associated with reaching this objective is that the top of the container is raised up well above ground level. This virtually eliminates dirt and other contaminates from being inadvertently kicked into the bubble solution by the user. Clean bubble solution means larger bubbles that last longer, and also greatly reduces the need for replacing bubble solution before it has been used up.

It is another object of this invention to make it possible and convenient to use the same container for both dipping large loops and for storing the bubble solution. Design features enabling the accomplishment of this object include using a vertically disposed container and providing a lid for the container. The vertically disposed nature of the container is important because the solution will not slosh around so readily in such a container, and because the container is easier to grasp and hold steady while the lid is being removed. One advantage realized by attaining this objective is that the need for transferring the solution back into a second storage container is eliminated.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

Six sheets of drawings are provided. Sheet one contains prior art FIGS. 1 and 2. Sheet two contains FIG. 3. Sheet three contains FIGS. 4, 5, and 6. Sheet four contains FIG. 7. Sheet five contains FIGS. 8 and 9. Sheet six contains FIGS. 10 and 11. In the detailed description below, reference will be made to the following attached drawings.

FIG. 4 is a top view the preferred embodiment of the bubble maker.

FIG. 5 is a cross-sectional side view of the preferred embodiment of the container taken at section V—V of FIG. 3.

FIG. 6 is a cross-sectional side view of the preferred embodiment of the container taken at section VI—VI of FIG. 3.

FIG. 9 is a perspective view of the first alternate bubble maker with the lid on.

DRAWING ITEM INDEX

Figure 1:
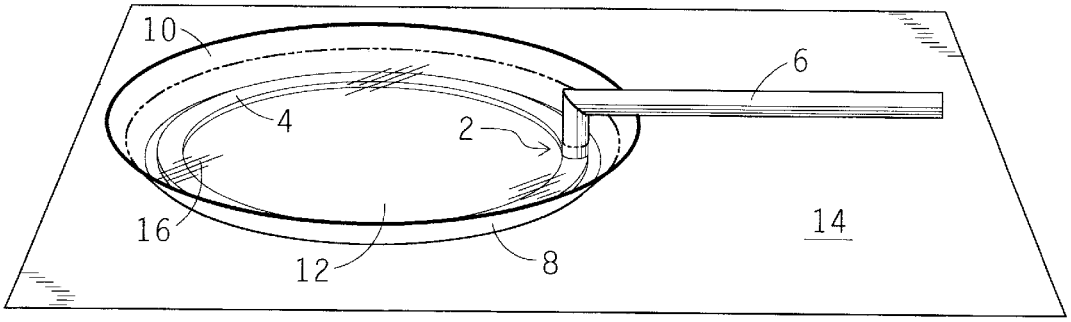
FIG. 1 PRIOR ART
FIG. 1 is a perspective view of a loop being dipped in a shallow, flat tray of the prior art.
Figure 2:
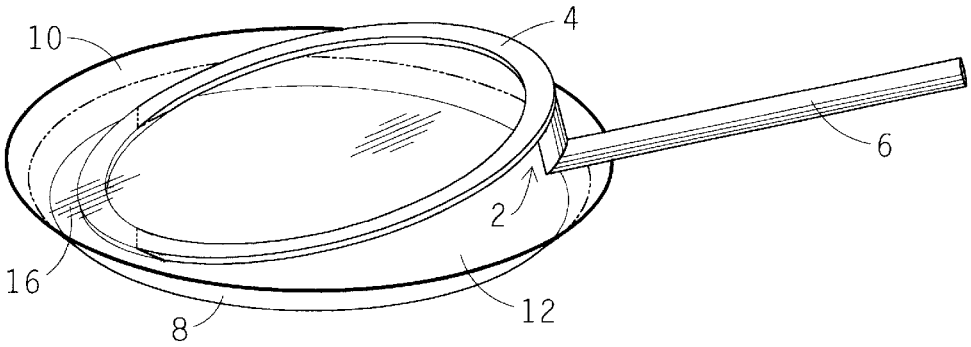
FIG. 2 PRIOR ART
FIG. 2 is a perspective view of a reversed loop being dipped in a shallow, flat tray of the prior art.

2 offset-handle wand
4 round loop
6 offset-handle
8 shallow, flat tray
10 tray sidewall
12 tray bottom
14 ground level
16 bubble solution
17 thin film
18 bubble maker
20 first alternate bubble maker
22 second alternate bubble maker
24 wand
26 second alternate wand
28 loop
30 second alternate loop
32 loop opening
33 maximum loop opening dimension
34 loop handle
36 loop width
38 container
40 first alternate container
42 second alternate container
44 holster feet

45 bottom
46 first alternate bottom
48 second alternate bottom
50 container sidewall
51 first alternate container sidewall
52 second alternate container sidewall
53 holster sidewall
54 reservoir sidewall
56 holster sidewall top edge
58 container sidewall upper rim
59 first alternate upper rim
60 container opening
61 first alternate container opening
62 container chamber
64 first alternate container chamber
66 second alternate container chamber
68 holster
70 holster chamber
72 reservoir
74 reservoir chamber
76 lid, top, cover, or cap
78 first alternate lid, top, cover, or cap
80 holster chamber width
82 reservoir chamber width
84 container chamber length
86 container chamber height
88 average width

Figure 3:
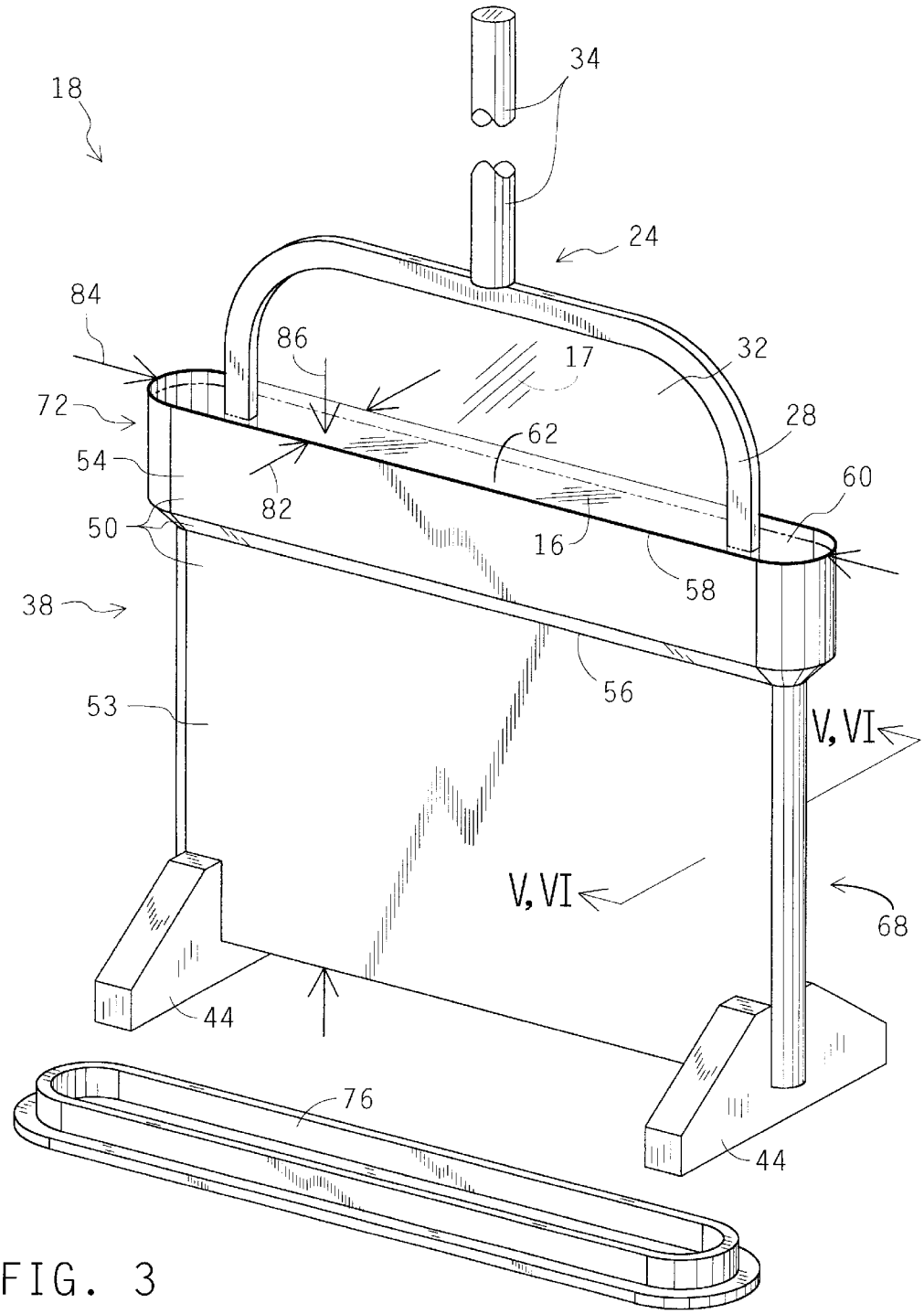
FIG. 3 is a perspective view of the preferred embodiment of the bubble maker.

COMPLETE DESCRIPTION OF THE PREFERRED EMBODIMENT:

FIG. 3 shows a perspective view of bubble maker 18 which includes bubble forming wand 24 and container 38. Bubble maker 18 may also include lid, top, cover, or cap 76. In FIG. 3, bubble forming wand 24 is being raised out of container 38.

Figure 9:
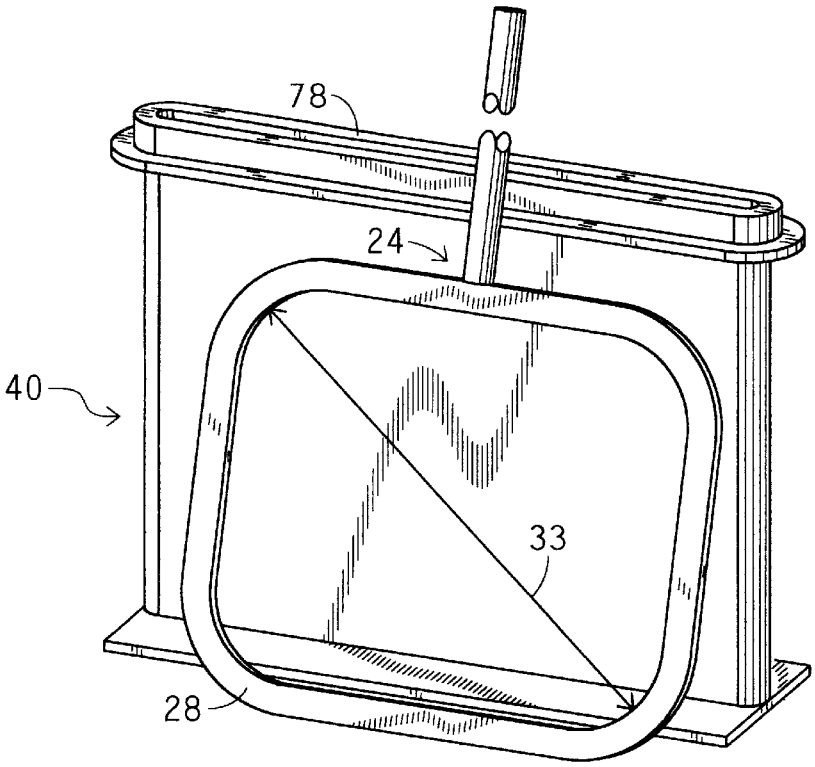

Wand 24 has three parts, loop handle 34, loop 28 and loop opening 32 inside loop 28. Loop handle 34 may be permanently attached to loop 28, but more likely, it will be detachable to save on shelf space at the store and storage space at home. Wand 24 may also be collapsible or foldable in some way. Loop opening 32 refers to the orifice inside loop 28 and is where thin film 17 of bubble solution 16 is formed upon dipping loop 28. In FIG. 3, wand 24 is oriented for dipping, which means that loop 28 lies in a vertical plane with loop handle 34 at the top. When a loop lies in a vertical plane, it may also be described as vertically oriented. We now define "maximum loop opening dimension". The "maximum loop opening dimension" for any loop corresponds to the longest straight line distance that can be found across a loop opening. FIG. 9 shows maximum loop opening dimension 33 for loop 28.

Container 38 of FIG. 3 is of unitary construction and has, an upper reservoir 72 atop a lower holster 68.

See FIG. 5. FIG. 5 is a cross-sectional side view of the preferred embodiment of container 38. Holster 68 has a bottom 45 and a peripheral, holster sidewall 53 that extends upwards from bottom 45 to holster sidewall top edge 56. Bottom 45 and holster sidewall 53 define an interior, holster chamber 70. Reservoir 72 has a peripheral, reservoir sidewall 54 that extends generally upward and outward from holster sidewall top edge 56. Reservoir sidewall 54 defines an interior, reservoir chamber 74. Holster sidewall 53 and reservoir sidewall 54 merge together forming a single, unified, peripheral, container sidewall 50 that has a container opening 60 at container sidewall upper rim 58. Reservoir chamber 74 communicates with holster chamber 70. Both reservoir chamber 74 and holster chamber 70 combined together form a single container chamber 62 that is capable of retaining liquid bubble solution 16 (not shown in FIG. 5). Container chamber 62 communicates with an exterior of container 38 through container opening 60.

For this and all containers of this invention, the directions corresponding to the length, width, and height dimensions are identified as follows: Length is assigned to be in a horizontal direction generally parallel to the longest horizontal dimension of the container chamber. Width is measured in a horizontal direction perpendicular to the length. Height is measured in a vertical direction. Container chamber length 84, reservoir chamber width 82, and container chamber height 86 are all shown in FIG. 3. FIG. 6 is a cross-sectional side view of the preferred embodiment of container 38 taken at section VI—VI of FIG. 3. The term "average width" becomes important for container chambers that have variations in width, such as with container 38 shown in FIG. 6, where the width of container chamber 62 is greater at the top than at the bottom. The average width of any container chamber refers to the mathematical average of the width for that container chamber. The average width for any particular container chamber can be found by employing standard mathematical averaging techniques. Average width 88 for container chamber 62 is shown in FIG. 6.

See FIG. 5. Container chamber 62 is designed so that reservoir chamber width 82 is generally greater than holster chamber width 80. There are at least three reasons for container chamber 62 to have this upper reservoir section that has an increased width. Refer to FIG. 3. First, when loop 28 is raised out of container 38, thin film 17 will be formed across loop opening 32. It is preferable to not have container sidewall upper rim 58 too close to thin film 17 since thin film 17 may pop if it makes contact with upper rim 58. Second, the depth of bubble solution 16 will drop more slowly as it gets used up because of the increased cross-sectional area of reservoir 72. This means that container 38 will have to be refilled with bubble solution 16 less frequently during use. Third, the greater reservoir chamber width 82 makes it easier to insert loop 28 into container 38. Without reservoir 72, it would be more difficult to line up loop 28 with narrow holster 68 for insertion of loop 28 into container 38.

FIG. 4 is a top view of the preferred embodiment of bubble maker 18. Further important design considerations of container 38 are as follows: Holster chamber 70 is designed to have an elongated top view shape that substantially conforms to a top view shape of loop 28 when loop 28 is oriented for dipping. Holster chamber width 80 is wide enough so that loop 28 will fit freely inside holster sidewall 53, but otherwise, holster chamber width 80 is kept as small as reasonably possible. Holster chamber width 80 is kept small so that the amount of bubble solution 16 (not shown in FIG. 4.) needed to fill holster chamber 70 is reduced. In practice, holster chamber width 80 will likely be from about one and a half to five times greater than loop width 36. Refer to FIG. 3. A further design consideration is that container chamber 62 is sized so that loop opening 32 can be inserted into container chamber 62 until loop opening 32 passes completely below container opening 60.

See FIG. 3. Holster feet 44 prevent container 38 from tipping over during normal use and while in storage. Holster feet 44 may be permanently attached to container 38 or they may snap on and off, or be otherwise attachable or removable. Making holster feet 44 removable from container 38 would allow container 38 to be sold with holster feet 44 either inside or flat against the outside of container 38 so that a plurality of bubble makers 18 could be more closely packed together on store shelves. Although FIG. 3 shows container 38 with two holster feet 44, it could also have only one holster foot 44, or it could have more than two holster feet 44. Container 38 could also be held upright by means other than feet. For example, container 38 could be held upright by extending all or part of bottom 45, shown in FIG. 5, outwards beyond holster sidewall 53 to form a stabilizing base or platform. An example of this is seen as first alternate bottom 46 shown in FIG. 7. Refer again to FIG. 5. Another stabilizing possibility would be to have legs that extend downward and outward from container sidewall 50 or from below bottom 45. Many variations of these and other stabilizing means would also be possible.

Lid, top, cover, or cap 76, shown in FIG. 3, may be included with bubble maker 18 so that it can be stored, when not in use, with bubble solution 16 still inside. Lid 76 may simply be a cover to prevent dirt, leaves, and other debris from falling into bubble solution 16, or it may be a snap-on type lid that seals container 38 to prevent spilling when container 38 is moved or tipped. FIG. 3 shows lid 76 next to container 38 since container 38 is in use in this Figure. After use, container 38 would be covered with lid 76 and then probably left outside on a porch or patio for later use. Covers or snap-on lids may also be used for these same reasons with any of the other embodiments described herein.

FIRST ALTERNATE EMBODIMENT

Figure 7:
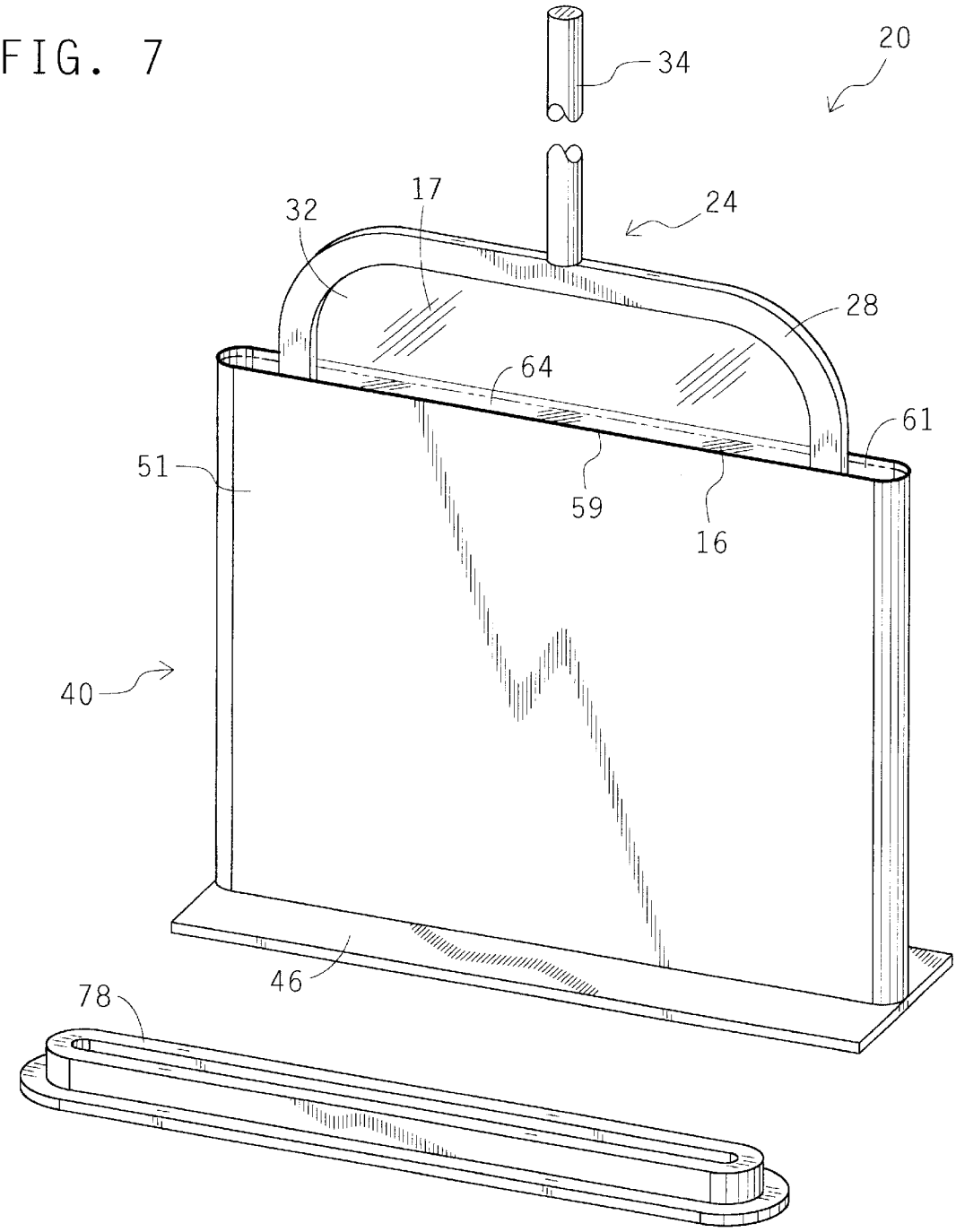
FIG. 7 is a perspective view of the first alternate bubble maker in use.

FIG. 7 shows a perspective view of first alternate bubble maker 20. First alternate bubble maker 20 includes the same bubble forming wand 24 used in the preferred embodiment as well as first alternate container 40. Generally, first alternate container 40 eliminates the upper reservoir portion of container 38 of the preferred embodiment. First alternate bubble maker 20 may also include first alternate lid, top, cover, or cap 78. FIG. 9 shows a perspective view of first alternate bubble maker 20 ready for storage. First alternate lid 78 is snapped onto first alternate container 40 for storage.

Figure 8:
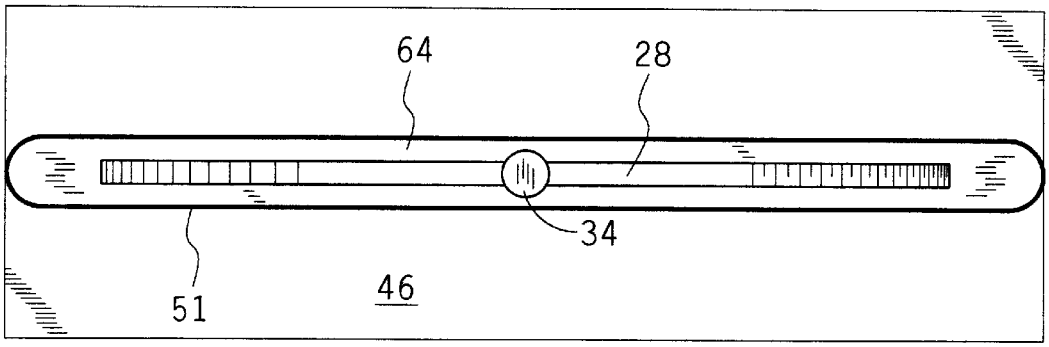
FIG. 8 is a top view of the first alternate bubble maker in use.

See FIG. 7. First alternate bottom 46 serves both as a bottom for first alternate container 40 and as a stabilizing base or platform to prevent first alternate container 40 from toppling over. First alternate container sidewall 51 extends upward from first alternate bottom 46 to a first alternate container opening 61 at first alternate upper rim 59. First alternate bottom 46 and first alternate container sidewall 51 define first alternate container chamber 64. FIG. 8 is a top view of first alternate bubble maker 20 in use. FIG. 8 shows that first alternate container chamber 64 is again designed to have an elongated top view shape that substantially conforms to a top view shape of loop 28 when loop 28 is oriented for dipping.

See FIG. 7. Although this first alternate embodiment is simple and functional, it is not optimal. The depth of bubble solution 16 will drop quickly during use due to the narrow width of first alternate container chamber 64. As a result, bubble solution 16 will soon become too shallow to fully submerge loop opening 32, and so first alternate container 40 will need to be refilled frequently. A second problem is that first alternate container sidewall 51 is quite close to thin film 17. If a breeze blows thin film 17 into first alternate container sidewall 51, there is a possibility thin film 17 will pop.

SECOND ALTERNATE EMBODIMENT

Figure 10:
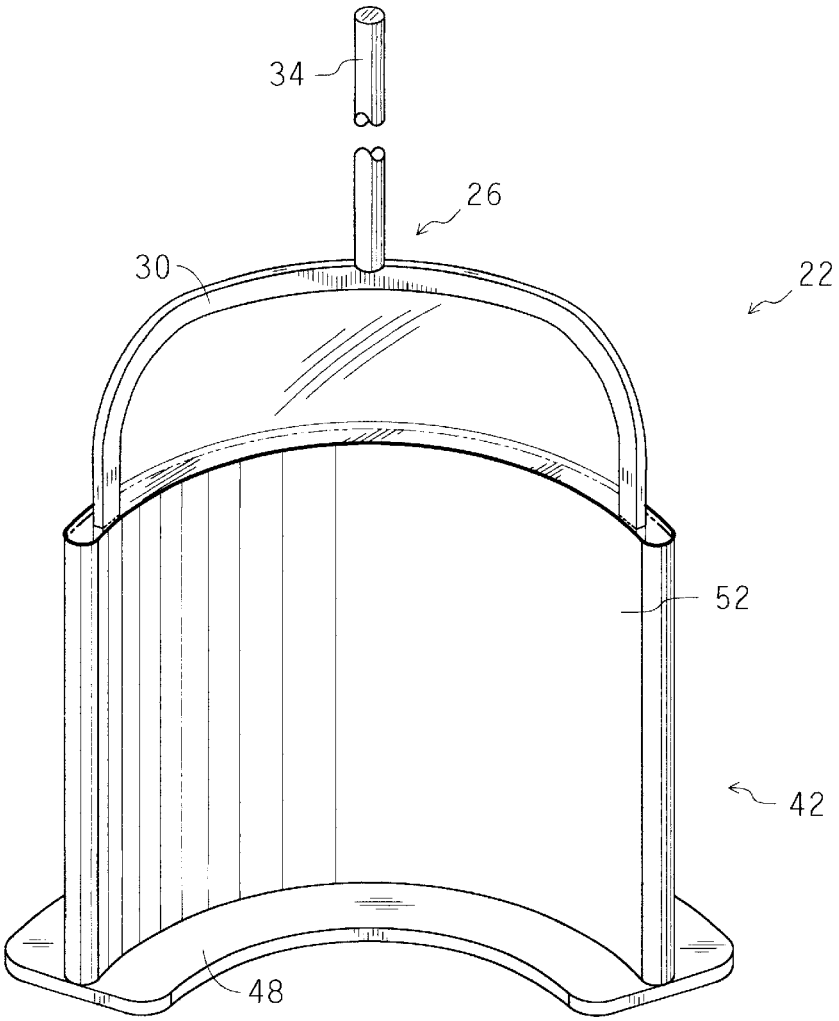
FIG. 10 is a perspective view of the second alternate bubble maker in use.
Figure 11:
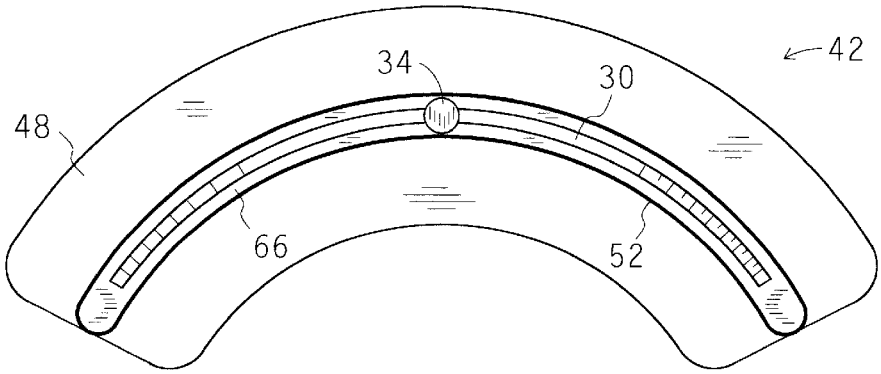
FIG. 11 is a top view of the second alternate container in use.

FIG. 10 shows a perspective view of second alternate bubble maker 22, which includes second alternate wand 26 and second alternate container 42. Second alternate wand 26 includes loop handle 34 and second alternate loop 30. FIG. 11 is a top view of second alternate container 42. Second alternate container 42 includes at least second alternate bottom 48 and second alternate container sidewall 52 which define an interior, second alternate container chamber 66. FIG. 11 shows that second alternate container chamber 66 is large enough to admit second alternate loop 30, and that second alternate container chamber 66 has a top view shape that is substantially conformal to the top view shape of second alternate loop 30 when oriented for dipping.

The purpose of this embodiment is to more clearly illustrate the scope of this invention and what is meant by saying that "the top view shape of the container chamber is substantially conformal to the top view shape of the loop when the loop is oriented for dipping". Loops and containers with top view "S" shapes, top view "V" shapes, and other top view shapes are also possible. Containers, such as the one shown in FIG. 10, could also include curved reservoirs (not shown) and curved lids (not shown).

See FIG. 10. The stabilizing means for this embodiment is second alternate bottom 48. However, in this embodiment it would be possible to eliminate second alternate bottom 48 as a stabilizing platform and use the curvature of second alternate container 42 itself for the stabilizing means.

DESCRIPTION OF PREFERRED EMBODIMENT BASED ON LIMITING DIMENSION

The preceding descriptions of the first three embodiments were concerned with reducing to a minimum the amount of bubble solution needed for dipping vertically oriented loops. This was achieved by having the top view shape of a container chamber conform to the top view shape of a loop oriented for dipping. For this reason, the claims covering the above embodiments include not only the bubble solution containers themselves, but also the loops that these containers conformed to.

However, if the claims for this invention describe containers having shapes that are tied to the shape of a loop, then it is uncertain whether these claims would cover a container of this invention when the container is sold separately from any loops. For this reason, the container of the preferred embodiment will now be redescribed without making any reference to a loop to which the container conforms. Instead, the container of the preferred embodiment will be described in terms of limiting dimensions, and these limiting dimensions will be chosen so that the container will be uniquely well suited for the purpose of dipping large, vertically oriented loops for blowing bubbles while reducing to manageable quantities the amount of bubble solution needed to fill the containers.

For our purposes, a loop will be considered large if it is easier to produce bubbles by waving the loop through the air than by blowing through the loop with one's mouth. To be specific, we will consider a loop to be large if the maximum loop opening dimension of the loop is greater than sixteen centimeters. Recall that the maximum loop opening dimension of a loop refers to the greatest straight line distance that can be found across the loop opening.

We will only be describing the container itself in this section. The functions and descriptions of the stabilizing means and lid will not be repeated here as they remain unchanged.

FIG. 3 shows a perspective view of container 38. See FIG. 5. Container 38 has a bottom 45 and a peripheral, container sidewall 50 that extends generally upwards from bottom 45 to a container opening 60 at container sidewall upper rim 58. Bottom 45 and container sidewall 50 define an interior container chamber 62 which is capable of retaining liquid bubble solution 16 (not shown in FIG. 5). Container chamber 62 communicates with an exterior of container 38 through container opening 60.

Container chamber 62 is designed to have an elongated top view shape, as shown in FIG. 4. Refer now to FIG. 3. The directions corresponding to the length, width, and height dimensions are identified the same as always: Length is assigned to be in a horizontal direction generally parallel to the longest horizontal dimension of container chamber 62. Width is measured in a horizontal direction perpendicular to the length. Height is measured in a vertical direction. Container chamber length 84 and container chamber height 86 are shown in FIG. 3.

See FIG. 6. The term "average width", although valid for all the containers of this invention, becomes especially important for container chambers that have variations in width, such as with container 38 shown in FIG. 6. FIG. 6 shows that the width of container chamber 62 is greater at the top than at the bottom. The average width of any container chamber refers to the mathematical average of the width for that container chamber. The average width for any particular container chamber can be found by employing standard mathematical averaging techniques. Average width 88 for container chamber 62 is shown in FIG. 6.

See FIG. 3. We must now decide on the specific limiting dimensions for this container. In keeping with our goal of having the container in this description uniquely well suited for dipping large, vertically oriented loops, container chamber length 84 and container chamber height 86 will each be twenty centimeters or greater.

In keeping with our goal of reducing the amount of bubble solution needed to fill the container in this description to a manageable amount, we limit average width 88, shown in FIG. 6, to be less than four centimeters.

GENERAL CONSIDERATIONS

The preferred material for a bubble maker would be some form of plastic, vinyl, rubber, or similar material. It may also be made of metal, fiberglass, or any other material that does not interfere with the container's functionality.

The description above contains many specificities in order to provide clear illustrations of some of the presently preferred embodiments of this invention. It is to be understood that changes, improvements, modifications, and variations may be made by those skilled in the art without departing from the spirit of the appended claims. Thus the scope of the invention should be determined by the appended claims and their legal equivalents rather than by the examples given.

I claim:

1. A bubble maker for reducing an amount of bubble solution needed for dipping large, vertically oriented loops capable of producing large bubbles by waving said loops through air, said bubble maker comprising a container and a wand, said wand comprising a loop, a loop opening in said loop, and a handle attached to said loop, said loop having a maximum loop opening dimension greater than sixteen centimeters, said container comprising a reservoir atop a holster, said holster having a bottom and a peripheral, holster sidewall extending generally upwards from said bottom to a top edge of said peripheral, holster sidewall, said bottom and said peripheral, holster sidewall defining a holster chamber, said holster chamber having a width sufficient for said loop, when vertically oriented, to fit freely inside said peripheral, holster sidewall, but otherwise, said holster chamber width is as small as possible, said reservoir having a peripheral, reservoir sidewall extending generally upward and outward from said top edge of said holster sidewall, said reservoir sidewall defining a reservoir chamber, said holster sidewall and said reservoir sidewall forming a container sidewall having a container opening at an upper rim of said container sidewall, said reservoir chamber communicating with said holster chamber, a width of said reservoir chamber being greater than a width of said holster chamber, said reservoir chamber and said holster chamber combining to form a container chamber capable of retaining a liquid bubble solution, said container chamber communicating with an exterior of said container through said container opening, said container chamber being sized so that said loop opening can be inserted into said container chamber until said loop opening passes completely below said container opening.

2. The bubble maker of claim 1, wherein said loop handle is attached to an outer surface of said loop opposite said loop opening, and said loop handle is coplanar with said loop.

3. The bubble maker of claim 1, further comprising a cover that fits over said container opening, whereby said container may be covered when not in use to prevent dirt and debris from entering said bubble solution.

4. The bubble maker of claim 1, further comprising a lid that seals said container opening, whereby said bubble solution inside said container will not spill or leak when said container is moved or tipped.

5. A bubble maker for reducing an amount of bubble solution needed for dipping large, vertically oriented loops capable of producing large bubbles by waving said loops through air, said bubble maker comprising a container and a wand, said wand comprising a loop, a loop opening in said loop, and a handle attached to said loop, said loop having a maximum loop opening dimension greater than sixteen centimeters, said container comprising a bottom and a peripheral, container sidewall extending generally upwards from said bottom to a container opening at an upper rim of said peripheral, container sidewall, said bottom and said peripheral, container sidewall defining an interior container chamber for retaining a liquid bubble solution, said container chamber communicating with an exterior of said container through said container opening, and said container chamber having a width sufficient for said loop, when vertically oriented, to fit freely inside said peripheral, container sidewall, but otherwise, said container chamber width is as small as possible, and said container chamber being sized so that said loop opening can be inserted into said container chamber until said loop opening passes completely below said container opening.

6. The bubble maker of claim 5, wherein said loop handle is attached to an outer surface of said loop opposite said loop opening, and said loop handle is coplanar with said loop.

7. The bubble maker of claim 5, further comprising a cover that fits over said container opening, whereby said container may be covered when not in use to prevent dirt and debris from entering said bubble solution.

8. The bubble maker of claim 5, further comprising a lid that seals said container opening, whereby said bubble solution inside said container will not spill or leak when said container is moved or tipped.

* * * * *